US005702296A

United States Patent [19]

Grano

[11] Patent Number: 5,702,296

[45] Date of Patent: Dec. 30, 1997

[54] PORTABLE VENTILATION SYSTEM

[75] Inventor: Lars Grano, Mora, Sweden

[73] Assignee: Grano Maleri & Dekor AB, Mora, Sweden

[21] Appl. No.: 739,195

[22] Filed: Oct. 30, 1996

[30] Foreign Application Priority Data

Oct. 31, 1995 [SE] Sweden ..... 9503840

[51] Int. Cl.[6] ..... F24F 7/013

[52] U.S. Cl. ..... 454/200; 454/244; 454/252; 165/54

[58] Field of Search ..... 165/54; 454/195, 454/200, 119, 237, 241, 243, 244, 249, 252, 903

[56] References Cited

U.S. PATENT DOCUMENTS

| | | | |
|---|---|---|---|
| 558,714 | 4/1896 | Bradley | 454/252 X |
| 1,800,237 | 4/1931 | Williams | 454/243 |
| 2,091,594 | 8/1937 | Innes | 454/119 |
| 4,905,579 | 3/1990 | Dame | 165/54 X |
| 5,000,081 | 3/1991 | Gilmer | 454/252 |

FOREIGN PATENT DOCUMENTS

| | | | |
|---|---|---|---|
| 1146357 | 5/1983 | Canada . | |
| 2 344 804 | 10/1977 | France . | |
| 60-238631 | 11/1985 | Japan | 454/249 |
| 981811 | 12/1982 | U.S.S.R. . | |
| 86/06461 | 11/1986 | WIPO . | |

*Primary Examiner*—Harold Joyce
*Attorney, Agent, or Firm*—Jacobson, Price, Holman & Stern, PLLC

[57] ABSTRACT

A portable ventilation system includes a portable unit (1) comprising a fan (11) for sucking-in fresh air from the outdoor atmosphere and blowing the fresh air into a room, and an extraction fan (12) for sucking foul air from said room and blowing the foul air into the outdoor atmosphere. The system includes a flexible air conduit (13) having two mutually separate passageways (131, 132) which are arranged so as to obtain a transfer of heat between the passageways, through the medium of a wall of one passageway (132). One end of one passageway (131) is connectable to the input side of the fresh-air suction fan (11) and one end of the remaining passageway (132) is connectable to the output side of the foul-air extraction fan (12). Remaining ends of the passageways are intended to be placed in connection with the outdoor atmosphere. The two passageways (131, 132) of the flexible conduit (13) may be divided into a number of concentrical sub-passageways which are disposed so that each alternate sub-passageway is associated with one passageway (131) and each other alternate sub-passageway is associated with the remaining passageway (132). A distributed, counter-flow heat-exchanging effect is obtained in this way.

5 Claims, 2 Drawing Sheets

PORTABLE VENTILATION SYSTEM

FIELD OF THE INVENTION

The present invention relates to portable ventilation system. The invention is primarily aimed at professional workmen who need to ventilate effectively temporary working sites of the kind where the air will often contain high concentrations of dust, solvents, fungicides, etc., for instance.

DESCRIPTION OF THE BACKGROUND ART

Building workers, such as carpenters, painters and carpet layers, often work in many different places. When working sites are located indoors, problems are often caused by the very poor quality of the air on the working site, due to the presence of dust or solvents in the air, for instance. It is not realistic in practice to alleviate this problem by installing a permanent ventilation system, because the workman often works in one and the same place for only a short period of time. Furthermore, it is not desirable to make permanent alterations to building structures in order to solve these relatively short-term problematic situations.

Endeavours to solve this problem have hitherto involved:

a) Ventilating through windows or doors when the weather is warm enough.

b) Using solely suction fans, although this will not generally solve the entire problem.

c) Ventilating in combination with heating fans, although this does not either afford a satisfactory solution.

d) Replacing harmful solvent with solvent that is believed to be less harmful.

These measures have not resulted in a truly effective solution. The object of the present invention is to eliminate this drawback to the greatest possible extent.

SUMMARY OF THE INVENTION

A portable ventilation system constructed in accordance with the invention includes a portable unit having a suction fan for sucking-in fresh air, a foul air extraction fan, and a flexible air conduit having two mutual separate passageways so arranged as to enable a transfer of heat to take place between the passageways through the medium of the wall of one passageway. One end of one passageway is connectable to the input side of the fresh-air suction fan and one end of the remaining passageway is connectable to the output side of the extraction fan, and the remaining ends of the passageways are intended to be placed in connection with the outdoor atmosphere.

These and other characteristic features of an inventive ventilation system will be evident from the following claims.

BRIEF DESCRIPTION OF THE DRAWINGS

The present invention will now be described in more detail with reference to the accompanying schematic drawings, in which.

DESCRIPTION OF A PREFERRED EMBODIMENT

Figure 1:
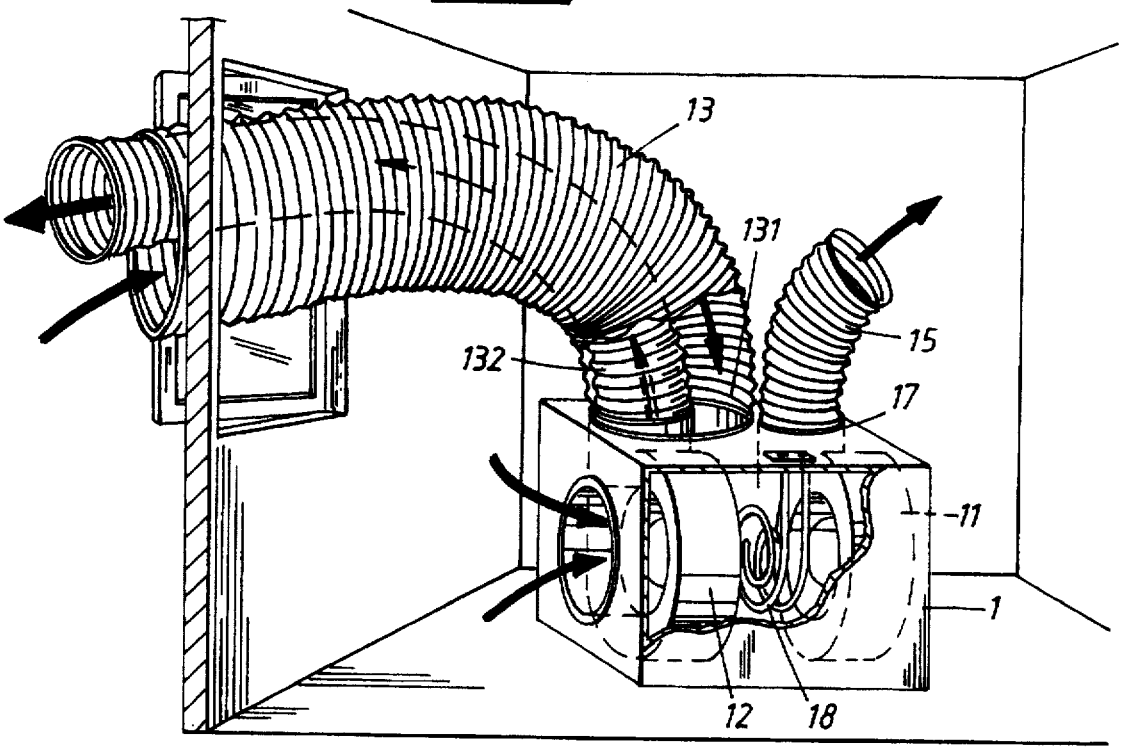
FIG. 1 illustrates a portable ventilation system constructed in accordance with the invention.

The ventilation system shown in FIG. 1 comprises a portable unit 1 that includes a suction fan 11 for sucking-in fresh air from the outdoor surroundings and blowing the fresh air into a room, an extraction fan 12 for sucking-in foul air from said room and blowing the foul air into the outdoor atmosphere, and a flexible conduit 13 having two mutually separated passageways 131, 132 and means for connecting a respective passageway to the input side of the suction fan 11 and to the output side of the extraction fan 12.

As will be seen from FIG. 1, the conduit 13 can be compressed or squeezed transversely to its longitudinal direction so that a window through which the free end of the conduit is placed in communication with the outside atmosphere need only be opened to a slight extent in cold weather conditions, therewith greatly reducing the extent to which the room is cooled by fresh air entering through the window.

The conduit 13 is constructed so that the fresh-air passageway 131 completely surrounds the foul-air passageway 132. This means that in wintertime, the cold fresh-air taken from the outdoor atmosphere will be heated by the hot foul air extracted from the room or space being ventilated. This effect can be accentuated still further, by dividing the two passageways 131, 132 of the conduit 13 into a number of concentrical sub-passageways that are arranged so that each alternate sub-passageway will be associated with one passageway 131 and each other alternate sub-passageway will be associated with the other passageway 132. Naturally, this will require the end piece of the conduit 13 located nearest the unit 1 to be correspondingly designed, so that sub-passageways belonging to a given passageway will mutually coact.

Also shown in FIG. 1 is a second flexible conduit 15 which is connected to the opening 17 of the portable unit 1 through which fresh air is blown out. This conduit can be given a considerable length, so that fresh air can be blown into the room at any desired location therein.

Figure 2:
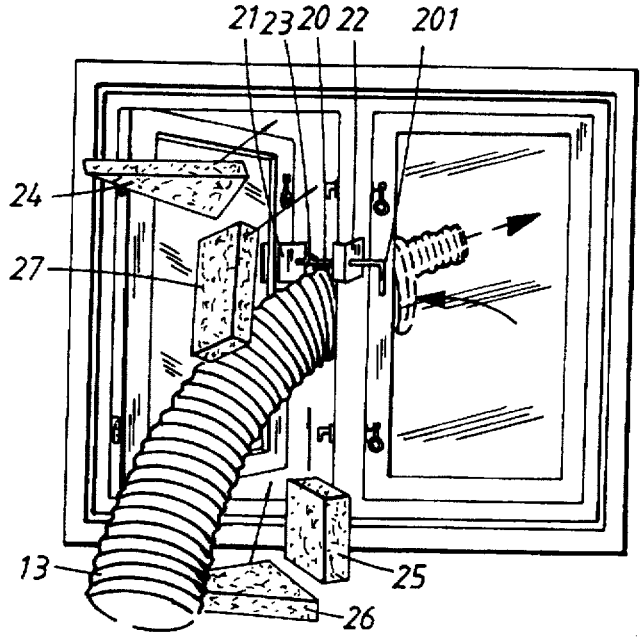
FIG. 2 is a more detailed illustration of an air conduit belonging to the ventilation system shown in FIG. 1 positioned in a window.

FIG. 2 shows the free end of the air conduit 13 extended through an open window. In order to prevent the room or space inwardly of the window becoming unpleasantly cool in cold weather conditions, the conduit is clamped between the partially open window and the window frame. The conduit is held firmly clamped to the window, in a slightly compressed state, with the aid of a clamping arrangement 21–20–22. The clamping arrangement is comprised of an outer clamp 21 which embraces the casement of the window, an inner plate 22 which is pressed firmly onto the window frame, and a rod 20 which connects the clamp 21 and the plate 22 and which is provided with a handle and forms means from which a hook 23 fixedly attached to the conduit 13 can be hung. The conduit 13 is compressed or squeezed together by pulling on the handle 201 and therewith securing the conduit to the window. Remaining parts of the window opening between the partially opened window and the window frame are conveniently sealed with the aid of pads 24, 25, 26, 27 made of a mechanically pliable, heat-insulating material.

Figure 3:
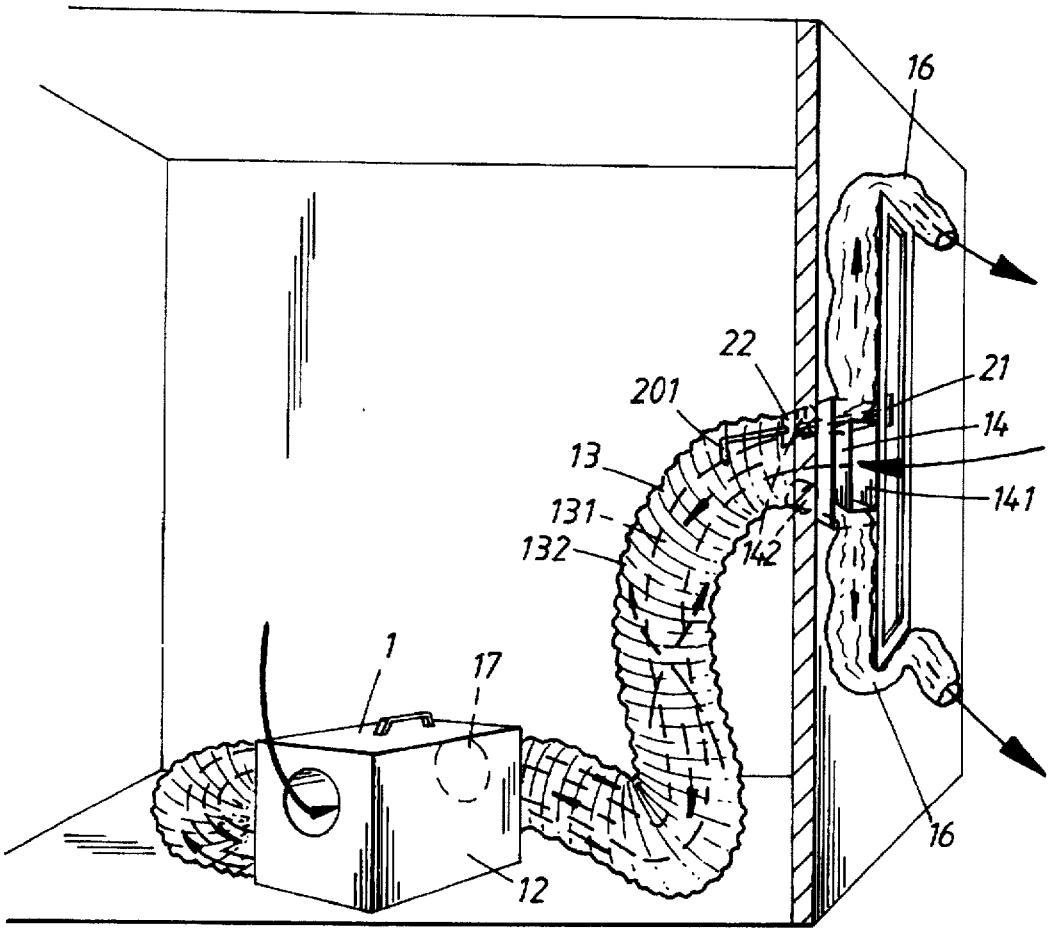
FIG. 3 illustrates a modified system having a separate nozzle means for mounting the air conduit in a window opening.

In the modified system shown in FIG. 3, the passageways 131, 132 are constructed differently and connected so that fresh-air is now sucked-in through the inner passageway 131 and the foul air is blown out through the outer passageway 132.

In the case of this embodiment, the pads 24–27 are replaced with two extension hoses 16. These hoses are attached so that air blown out from the passageway 132 passes through said hoses and out to the outdoor surroundings. The hoses 16 are placed in the window so as to substantially fill the gap presented by the partially open window, when inflated by the pressure from the fan 12.

A window passage nozzle 14 includes rod 20 and hook 23 on which the conduit 13 is hung, and is tightened between the window casement and the window frame in the same manner as that described with reference to FIG. 2.

The conduit 13 and the space-filling hoses 16 are connected (connectable) to the nozzle 14.

The nozzle 14 is constructed so that the opening 141 for the suction passageway 131 widens towards the outdoor atmosphere, and the passageway 132 through which foul air is blown is divided into to two smaller sub-passageways which are connected to passageway openings 142. The space-filling hoses 16 are connected (connectable) to the outside of these openings.

I claim:

1. A portable ventilation system, which comprises a suction fan (11) for sucking-in fresh air from the outdoor atmosphere and blowing said fresh air into a room, an extraction fan (12) for extracting foul air from said room and causing the foul air to be blown into the outdoor atmosphere; and a flexible air conduit (13) intended to be mounted in a gap defined by a partially opened window and which has two mutually separate passageways (131, 132) arranged for the transfer of heat between said passageways through the medium of a wall of one passageway (132), wherein one end of one passageway (131) being connectable to the input side of the fan (11) through which fresh air is sucked-in and the other end of the passageway (132) is connectable to the output side of the foul-air extraction fan (12), and wherein the remaining ends of the passageways (131, 132) are disposed for the free flow of air therethrough from/to the outdoor atmosphere outside the only partially open window.

2. A ventilation system according to claim 1, wherein the air conduit (13) has a compressible part which is intended to be placed in the gap defined by the partially opened window.

3. A ventilation system according to claim 1, further including a nozzle means (14) which is intended to be placed in the gap defined by the partially open window and which coacts with said remaining ends of the passageways (131, 132), wherein one side of said nozzle means includes openings for said remaining ends and the opposite side includes openings for connection of inflatable gap-filling hoses (16) through which extracted foul air passes and which are positioned in the window opening with their free ends located in the outdoor atmosphere.

4. A ventilation system according to claim 3, wherein the openings on said opposite side of the nozzle means (14) are three in number and comprise a central intermediate and relatively large opening in the middle intended for air that is sucked-in, and an upper and a lower relatively small opening on each side of the central opening for receiving extracted air.

5. A ventilation system according to claim 1, wherein in that the connection to the fan (11) which sucks-in fresh air includes a heating element (18) for heating said fresh air.

* * * * *